US005655829A

United States Patent [19]

Lin et al.

[11] Patent Number: 5,655,829

[45] Date of Patent: Aug. 12, 1997

[54] FLOODLIGHT ASSEMBLY

[75] Inventors: Chien-Ting Lin; Chao-Chuan Chieh, both of Panchiao, Taiwan

[73] Assignee: Kintron Industries (M) SDN BHD, Taipei, Taiwan

[21] Appl. No.: 494,330

[22] Filed: Jun. 26, 1995

[51] Int. Cl.[6] ..... F21V 21/00

[52] U.S. Cl. ..... 362/145; 362/249; 362/250; 362/431

[58] Field of Search ..... 362/153, 153.1, 362/145, 249, 250, 226, 430, 431; 248/156, 530, 532

[56] References Cited

U.S. PATENT DOCUMENTS

| | | | |
|---|---|---|---|
| D. 333,529 | 2/1993 | Denison et al. . | |
| 1,461,285 | 7/1923 | Olsen | 362/226 |
| 1,542,575 | 6/1925 | Perry | 362/249 |
| 4,827,389 | 5/1989 | Crum | 362/431 |
| 4,894,759 | 1/1990 | Siems | 362/250 |
| 5,086,379 | 2/1992 | Denison et al. | 362/431 |
| 5,154,642 | 10/1992 | Chung-Yin . | |
| 5,249,112 | 9/1993 | Bray . | |
| 5,297,013 | 3/1994 | Hall et al. . | |
| 5,337,993 | 8/1994 | Hersman . | |
| 5,384,694 | 1/1995 | Yang . | |
| 5,386,356 | 1/1995 | Davis, Jr. et al. . | |
| 5,398,180 | 3/1995 | Lee | 362/431 |

*Primary Examiner*—Ira S. Lazarus
*Assistant Examiner*—Sara Sachie Raab
*Attorney, Agent, or Firm*—Gifford, Krass, Groh, Sprinkle, Patmore, Anderson & Citkowski

[57] ABSTRACT

A multi-configurable floodlight assembly may be configured to provide suitable lighting in a multitude of situations. The assembly includes a housing having top portion, side portion and bottom portion. The portions define a substantially hollow volume therebetween. Three threaded recesses are formed in the top portion of the housing, and at least one threaded recess is formed in the bottom portion. A plurality of knockouts are extend circumferentially around the side portion of the housing. Two light holders are provided each of which having a light socket for receiving a light bulb, a threaded base portion, and an universal joint disposed between the base portion and the light socket to provide for the movement of the light socket about the base portion. The threaded base portion is releasably insertable into any of the threaded recesses in the housing. To mount the floodlight assembly, a pair of flanges are provided secured to the housing that have an aperture therethrough to allow the receipt of a nail or screw. Alternatively, a mounting spike adapted to be secured to any of the threaded recesses or knockouts may be used.

5 Claims, 2 Drawing Sheets

FLOODLIGHT ASSEMBLY

BACKGROUND OF THE INVENTION

I. Field of the Invention

The present invention relates to a lighting fixture, in general, and more particularly, to a novel multi-configurable floodlight assembly which can be adapted for use in a number of different situations.

II. Background of the Invention

Outdoor lighting has both utilitarian and aesthetic uses. For example, illumination of the areas around one's home, such as the yard, patio, walkway, or deck provides one with the safety and security associated with a well-lit area. Illumination also allows one to perform tasks around the home at night that otherwise could not be completed efficiently. In addition to its utilitarian aspect, outdoor lighting can have significant aesthetic uses as well. Modern lighting design is increasingly concerned with creating a balanced, comfortable and appealing environment, coordinated with the decorative and architectural scheme of the space to which the lighting is a part. Today, outdoor lighting has brought a more subtle enhancement to the illumination of homes, restaurants, museums, gardens, terminals, vehicles, sculptures, and virtually every kind of space used by people. Lighting is as much an art as it is a science.

There are many different types of outdoor lighting fixtures in use today. In the landscaping industry, decorative low voltage lighting fixtures are typically designed to fit securely in the ground. A stake having a pointed edge is usually connected at the end opposite the fixture. The fixture is then positioned by driving the pointed stake into the ground to a desired depth, leaving the fixture above the ground in its desired position. The fixture usually includes a light bulb positioned within a globe that both protects the lightbulb and diffuses light emitted from the bulb. For example, a series of lighting fixtures may be lined up along the opposite sides of a sidewalk leading from the driveway to the front door of a residence. These fixtures typically contain lights of low-wattage and do not provide illumination of much intensity.

Floodlights are well-known and unlike typical landscaping fixtures, are commonly used to brightly illuminate large open areas. Floodlights typically are much brighter and therefore require fewer numbers than landscape lights to provide ample illumination. Floodlights have been traditionally designed for mounting at a height, such as to a wall or privacy fence, to light up a patio, a pool or yard, or for mounting to the floor or ceiling to act as "task-light" lighting for a garage, barn or loft or any other high-ceiling work area. Unlike landscape lighting fixtures, floodlights are not typically used for decorative lighting. However, some people have recognized the advantages associated with brightly illuminating large natural features such as trees and shrubs with floodlights. As a result, floodlights have recently been specifically designed for mounting near or in the ground, such as on grass or in a shrub bed, to act as a touch of nighttime landscaping artistry to highlight certain areas.

However, no floodlights are known that are capable of quick and easy interconversion between multiple configurations. Therefore, the general consumer is forced to purchase a number of lighting fixtures or floodlights in different configurations to meet different lighting objectives that may otherwise be met by one easily configurable floodlight assembly.

Accordingly, it is therefore a general object of the present invention to provide a floodlight assembly that is easily configurable such that a general consumer may configure the floodlight assembly to meet a number of different lighting situations quickly and easily.

In accordance with this and many other objects, I have invented a novel floodlight assembly that addresses the problems others have failed to address.

SUMMARY OF THE PRESENT INVENTION

The floodlight assembly of the present invention is adapted to be easily configured in a number of different configurations to provide suitable lighting in a multitude of situations. The assembly includes a housing having top portion, side portion and bottom portion. The portions define a substantially hollow volume therebetween. Three threaded recesses are formed in the top portion of the housing, and at least one threaded recess is formed in the bottom portion. A plurality of knockouts are extend circumferentially around the side portion of the housing. Two light holders are provided, each of which having a light socket for receiving a light bulb, a threaded base portion, and an universal joint disposed between the base portion and the light socket to provide for the movement of the light socket about the base portion. The threaded base portion is releasably insertable into any of the threaded recesses in the housing. A spanner nut selectively frictionally couples the base portion of the light holder to the housing, such that the light holder is rotatable about the housing and may be positioned in multiple orientations. A closure plug is releasably secured to at least one of the threaded recesses disposed in the top or bottom members of the housing. To mount the floodlight assembly, a pair of flanges are provided secured to the housing that have an aperture therethrough to allow the receipt of a nail or screw. Alternatively, a mounting spike adapted to be secured to any of the threaded recesses or knockouts may be used. Power is supplied to the floodlight assembly by securing a power cord in one of the knockouts or one of the threaded recesses.

The floodlight assembly is easily interconverted between a number of mounting configurations and lighting orientations. The assembly may be mounted on a horizontal or vertical surface at a height, such as on a ceiling or fence, respectively, or in the ground through the use of a spike. The light holders may be positioned in the recesses and knockouts in any one of multiple configurations depending on the lighting effect desired.

BRIEF DESCRIPTION OF THE DRAWINGS

Additional objects, advantages, and features of the present invention will become apparent from the following description and appended claims, taken in conjunction with the accompanying drawings, in which:

DETAILED DESCRIPTION OF A PREFERRED EMBODIMENT OF THE PRESENT INVENTION

It should be understood that the following description of the preferred embodiments is merely exemplary in nature and is in no way intended to limit the invention or its applications or uses. Modifications and variations of the present invention will readily occur to those skilled in the art.

Figures 1, 2, 3:
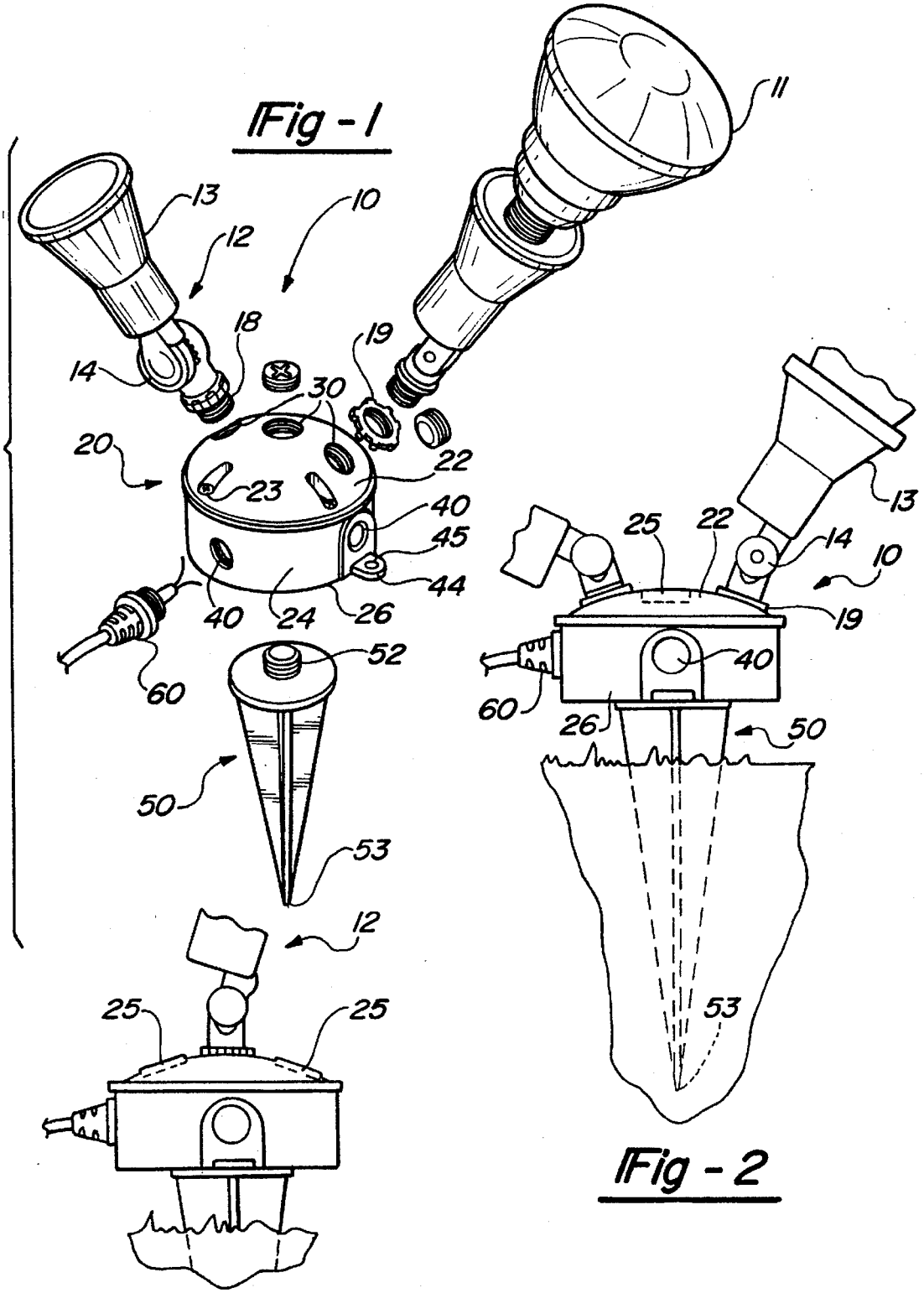
FIG. 1 is an exploded perspective view of the present invention.
FIG. 2 is a side view of the present invention shown mounted to the ground in one possible configuration.
FIG. 3 is a side view of the present invention shown mounted to the ground in a second possible configuration.

Referring now to the drawings, in which corresponding parts are identified with the same reference numeral, and more particularly to FIG. 1, the floodlight assembly of the present invention is designated generally at 10 and is shown in an exploded perspective view. The floodlight assembly 10 includes a housing 20 having a top portion 22, a side portion 24 and a bottom portion 26. The side portion 24 is integrally formed with the bottom portion 26 and extends vertically upward from the bottom portion 26. The top portion 22 is releasably secured to the side portion 24 through the use of screws 23. The top, bottom and side portions define a partially hollow volume therebetween. Three threaded recesses 30 are shown formed in the top portion 22. The recesses 30 extend from the top portion 22 to the interior of the housing 20 and are adapted to secure a light holder 12. Each light holder 12 includes a light socket 13 connected to a threaded base portion 18. The light socket 13 contains an internal threaded recess (not shown) for securely receiving a light bulb 11 and provides an electrical connection to the light bulb 11. A universal joint 14 connects the light socket 13 and base portion 18 and allows the light socket 13 to pivot in a vertical plane. The threaded base portion 18 is releasably insertable into any of the threaded recesses 30 in the top portion 22. A spanner nut 19 selectively frictionally couples the base portion 18 of the light holder 12 to the top potion 22 of the housing 20, such that the light holder 12 is rotatable about the top portion 22 of the housing 20.

Electrical wires (not shown) extend from the light socket 13 into the base portion 18 and then into the housing 20. An electrical power cord 60 may then be coupled to the housing 20 and consequently connected to the electrical wires from the light socket 13 to provide electrical power. A plurality of knockouts 40 are formed in the side portion and provide access to the interior of the housing 20. The electrical power cord 60 may be connected to the housing 20 through any of the knockouts 40.

With further reference to FIG. 1, a threaded recess is also formed on the bottom portion 26 (not shown). The threaded recess is identical to the threaded recesses 30 on the top portion 22 and therefore is capable of securely receiving the threaded base portion 18 of the light holder 12. A mounting spike 50 is provided which is adapted to securely fit into any of the threaded recesses 30 on the top portion 22 or bottom portion 26 of the housing 20, as well as in any of the knockouts 40.

As will readily become apparent, although the preferred embodiment of the present invention was designed with three threaded recesses 30 formed on the top portion, one threaded recess formed on the bottom portion, and four knockouts 40 spaced around the side portion 24, the number and location of the recesses 30 and knockouts 40 can be easily modified in keeping with the fundamental aspects of the present invention.

With reference now to FIG. 2, the floodlight assembly 10 is shown mounted in the ground. In this configuration, the mounting spike 50 is shown secured to the recess on the bottom portion 26. The spike 50 has a pointed edge 53 that is connected at the end opposite to the threaded portion 52. The floodlight assembly 10 may be positioned by driving the spike 50 into the ground to a desired depth. Two light holders 12 are shown secured to two threaded recesses 30 in the top portion 22. By adjusting the spanner nut 19 and universal joint 14, the light holders 12 may be aligned to point in a number of different directions. To cover the unused recess on the top potion 22, a closure plug 25 may be secured thereto. Power is supplied through the attachment of the power cord 60 to one of the knockouts 40.

Figure 4:
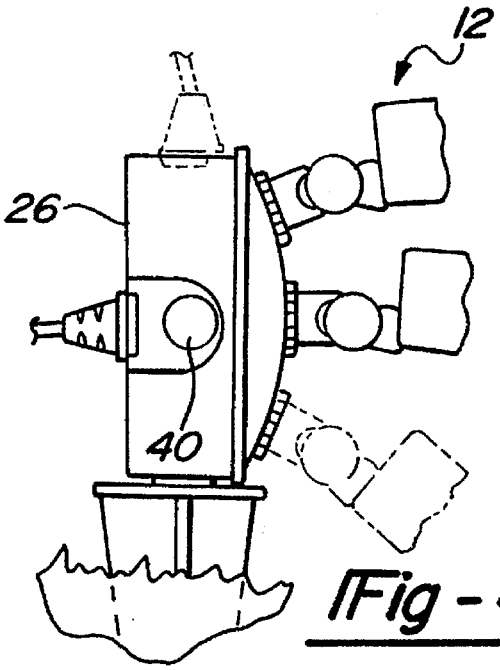
FIG. 4 is a side view of the present invention shown mounted to the ground in a third possible configuration.

Multiple configurations exist for mounting the floodlight assembly 10 in the ground. As shown in FIG. 3, a light holder 12 may be positioned in just one of the threaded recesses 30. In this configuration, the unused recesses are shown covered by closure plugs 25. FIG. 4 shows three light holders 12, each positioned in one of the three recesses 30. Instead of being secured to the recess in the bottom portion 26, the mounting spike 50 is shown secured to one of the knockouts 40 in the side portion 24. In this configuration, the light holders 12 face a substantially horizontal direction.

Figure 5:
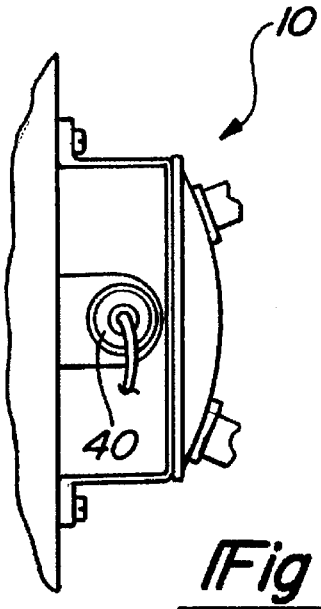
FIG. 5 is a side view of the present invention shown secured to a vertically inclined surface in a first configuration.

Numerous configurations exist for mounting the floodlight assembly 10 to a ceiling or wall. Referring back to FIG. 1, two flanges 44 extend outward from the bottom portion 26 opposite one another. The flanges 44 have an aperture 45 therethrough for receiving a nail or screw to facilitate mounting. Turning now to FIG. 5, the floodlight assembly 10 is shown mounted to a vertical wall such as a fence. The power cord 60 is shown attached to one of the knockouts 40. This configuration finds use when it is desired to mount the floodlight assembly 10 on a structure not in electrical connection with a building, such as on a fence. The power cord 60 may then extend from the knockouts 40 to an electrical outlet affixed to the building.

Figure 6:
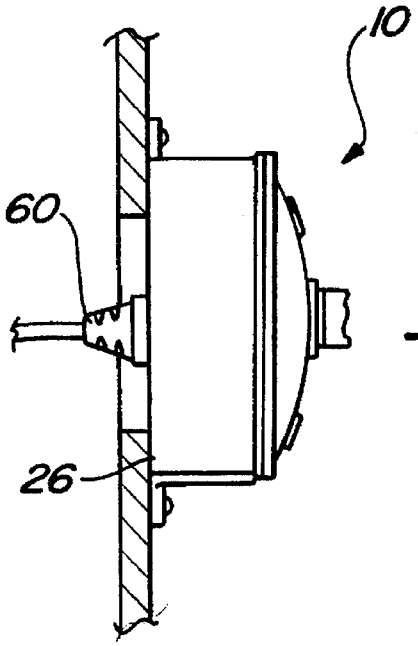
FIG. 6 is a side view of the present invention shown secured to a vertically inclined surface in a second configuration.

FIG. 6 shows the floodlight assembly 10 mounted to a ceiling or a floor inside the structure or a wall of the structure. The power cord 60 is shown extending from the recess in the bottom portion 26 though the wall and ultimately to an electrical power source.

Since the floodlight assembly 10 of the present invention has multiple configurations, the user must first evaluate the physical environment where lighting is needed and determine the lighting effect desired. For example, should the user desire to light up his patio, pool or yard, the assembly 10 may be mounted on an exterior wall of the house through the use of the mounting flanges 44. The user may then chose to use one or more light holders 12 depending on the amount of light and area that is in need of illumination. Should the user desire to use the floodlight assembly 10 to accent landscaping features or perhaps light up a walkway, the user may want to use the mounting spike 50.

Changing the configuration of the assembly 10 is made quite easy even for the general consumer. With the use of a screwdriver, the user can unscrew screws 23 and remove the top portion of housing 20. By doing so, the user would expose the electrical connections between the power cord 60 and the light holders 12. Quick manipulation of the electrical wires would allow the user to modify the number and placement of the light holders about the housing. Moreover, since the light holders 12 are threadedly received in the recesses or knockouts, the light holders 12 may be removed or their positions modified by merely rotating the spanner nut 19 and then unscrewing the appropriate light holder 12.

As will be apparent to one of ordinary skill in the art, the preferred embodiment of the invention has been set forth in the drawings and specification, and although specific terms are employed, these are used in a generic or descriptive sense only and are not used for purposes of limitation.

Changes in the form and proportion of parts as well as in the substitution of equivalents are contemplated as circumstances may suggest or render expedient without departing from the spirit or scope of the invention as further defined in the following claims.

Having thus described my invention, we claim:

1. A floodlight assembly comprising:

a housing, the housing including a top portion, a bottom portion, and a side portion, the top, side and bottom portions defining a substantially hollow volume therewithin;

at least one threaded recess disposed in the top portion;

at least one threaded recess formed in the side portion or bottom portion;

at least one light holder having a threaded base to be threadably received by one of the recesses, the light holder further including a light socket for receiving a light bulb, and a universal joint disposed between the threaded base and the light socket to provide for movement of the light socket with respect to the base; and means, attached to the housing, for mounting the housing to a fixed surface.

2. The floodlight assembly of claim 1, wherein the mounting means comprises a spike, the spike having a top threaded portion for releasable insertion into the threaded recess, and a bottom pointed portion for insertion into the fixed surface.

3. The floodlight assembly of claim 1, wherein the mounting means comprises at least one flange extending outwardly from the housing, the flange having an aperture for receiving a screw therethrough.

4. A floodlight assembly, comprising:

a housing have a top portion, a bottom portion and a side portion;

at least one threaded recess formed in the top, bottom or side portion;

a plurality of light holders, each of the light holders adapted to be secured in any of the threaded recesses; and a mounting spike adapted to be secured in any of the threaded recesses to secure the floodlight assembly to the ground.

5. A floodlight assembly, comprising:

a housing, the housing including a top portion, a bottom portion, and a side portion, the top, side and bottom portions defining a substantially hollow volume therebetween, a plurality of threaded recesses formed in the top portion;

at least one threaded recess formed in the bottom portion;

a plurality of knockouts formed in the side portion;

at least one light holder threadedly received in any of the recesses or knockouts, the light holder having a light socket for receiving a light bulb, a threaded base, and an universal joint disposed between the threaded base and the light socket to provide for movement of the light socket about the base;

a nut for selectively frictionally coupling the base of the light holder to the top portion of the housing, such that the light holder is rotatable about the housing and may be positioned in multiple configurations about the housing;

a pair of flanges extending outwardly from the housing, the flanges having an aperture for receiving a screw therethrough;

at least one closure plug releasably secured to any of the threaded recesses; and means for mounting the housing to a fixed surface, said means including a spike, the spike having a top threaded portion for releasable insertion into a recess or knockout, and a bottom pointed portion for insertion into a fixed surface.

* * * * *